US006997792B2

(12) United States Patent
Lin

(10) Patent No.: US 6,997,792 B2
(45) Date of Patent: Feb. 14, 2006

(54) DUSTPROOF GRINDER

(75) Inventor: Freddy Lin, Taichung (TW)

(73) Assignee: Gison Machinery Co., Ltd., Taichung Hsien (TW)

( * ) Notice: Subject to any disclaimer, the term of this patent is extended or adjusted under 35 U.S.C. 154(b) by 0 days.

(21) Appl. No.: 11/045,363

(22) Filed: Jan. 31, 2005

(65) Prior Publication Data

US 2005/0287939 A1 Dec. 29, 2005

Related U.S. Application Data

(63) Continuation-in-part of application No. 10/937,249, filed on Sep. 10, 2004.

(30) Foreign Application Priority Data

Jun. 29, 2004 (TW) ..... 93119061 A

(51) Int. Cl.
*B24B 23/03* (2006.01)
*B24B 47/26* (2006.01)

(52) U.S. Cl. ..... 451/359; 451/357
(58) Field of Classification Search ..... 451/357, 451/359, 456, 270
See application file for complete search history.

(56) References Cited

U.S. PATENT DOCUMENTS 5,839,950 A * 11/1998 Johansson Edling et al. ..... 451/359
5,993,305 A * 11/1999 Chu ..... 451/357

FOREIGN PATENT DOCUMENTS

EP 0254850 * 2/1988 ..... 451/357
FR 2366913 * 5/1978 ..... 451/359

* cited by examiner

*Primary Examiner*—Robert A. Rose
(74) *Attorney, Agent, or Firm*—Troxell Law Office, PLLC

(57) ABSTRACT

A dustproof grinder including: a main body; a rotary shaft vertically mounted in the main body and drivable by the driving unit, a bottom end of the rotary shaft having a plane face facing downward; a bottom cover formed with a central through hole, the bottom cover being disposed at the bottom end of the main body; the plane face of the rotary shaft being larger than the through hole and positioned above top face of the bottom cover; and a sealing member disposed between the plane face and the top face of the bottom cover. A grinding disc is mounted at a bottom end of the rotary shaft for grinding or buffing an object. The bottom cover is sealed with the bottom end of the main body, also, the bottom cover is sealed with the plane face so that the dirt, dusts and chips are prevented from entering the interior of the grinder.

14 Claims, 6 Drawing Sheets

DUSTPROOF GRINDER

This application is a Continuation-in-Part of application Ser. No. 10/937,249, entitled GRINDER WITH EASILY INSTALLABLE/DETACHABLE GRINDING DISC, filed on Sep. 10, 2004.

FIELD OF THE INVENTION

The present invention is related to a grinder, and more particularly to a grinder having dustproof effect for preventing dirt, dusts and chips from entering the interior of the grinder.

BACKGROUND OF THE INVENTION

A conventional grinder has a driving unit mounted in the main body of the grinder. In the case of a pneumatic grinder, the driving unit is a pneumatic cylinder. In the case of an electric grinder, the driving unit is a motor. The driving unit serves to drive a rotary shaft to rotate. The rotary shaft is positioned at bottom end of the main body. In use, a grinding disc is connected with and driven by the rotary shaft for grinding or buffing an object.

In the conventional grinder, a gap exists between the grinding disc and the bottom end of the main body of the grinder. Therefore, the dirt, dusts and chips produced in grinding operation are easy to enter the interior of the grinder. Therefore, the internal components of the grinder tend to be contaminated. As a result, the function of the grinder will be affected. For example, in the case that the lubricant is polluted with the dirt, the quality of the lubricant will be deteriorated to reduce the lubrication effect between the components or even lead to clog of the components.

SUMMARY OF THE INVENTION

It is therefore a primary object of the present invention to provide a grinder having dustproof effect for preventing dirt, dusts and chips from entering the interior of the grinder and keeping the interior of the grinder clean.

The present invention can be best understood through the following description and accompanying drawings wherein:

DETAILED DESCRIPTION OF THE PREFERRED EMBODIMENTS

Figure 1:
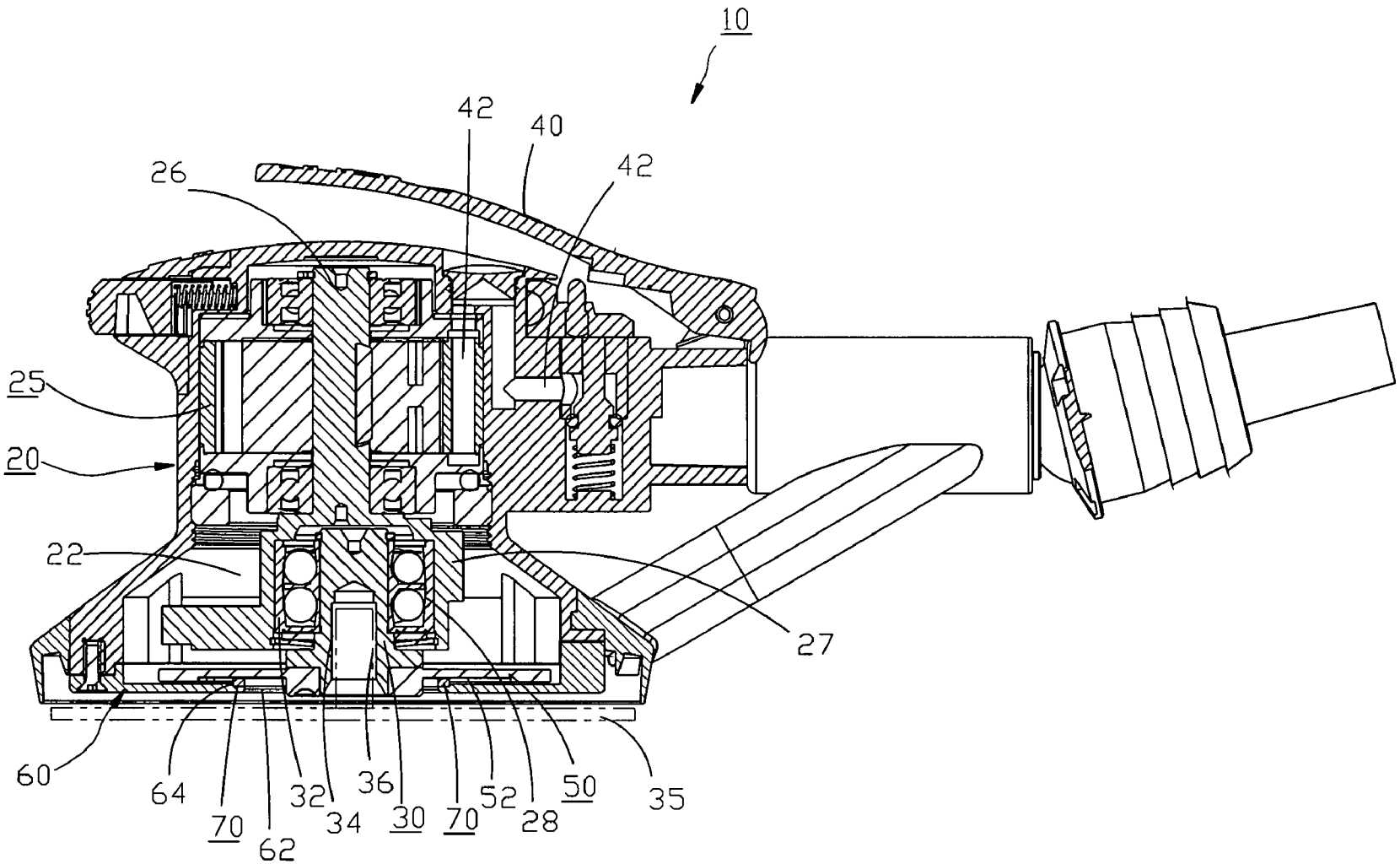
FIG. 1 is a longitudinal sectional view of a preferred embodiment of the present invention.

Please refer to FIG. 1. The grinder 10 of the present invention can be a pneumatic grinder or an electric grinder. The grinder 10 that in the embodiment is a pneumatic one includes a main body 20 having an open bottom end. A space 22 inward extends from the bottom end. A driving unit which is a pneumatic cylinder 25 (or a motor in the case of electric grinder) is mounted in the main body 20. The pneumatic cylinder has a driving shaft 26. In an ordinary pneumatic grinder, the bottom end of the driving shaft has a projecting block 27 protruding from the bottom end of the pneumatic cylinder 25. A rotary shaft 30 is connected with and drivable by the driving shaft 26 in such a manner that the top end of the rotary shaft 30 is fitted with a bearing 32 and then fitted in a recess 28 of the projecting block 27 of the driving shaft 26. The bottom end of the rotary shaft 30 is formed with a pivot hole 34. A central shaft 36 of a grinding disc 35 (as shown by the phantom line) is fitted in the pivot hole 34.

In use, by means of pulling a trigger 40, high-pressure gas can enter the flow way 42 in the main body 20 for driving the driving shaft 26 of the driving unit 25 to rotate. The rotary shaft 30 is driven by the driving shaft to drive the grinding disc 35 for grinding or buffing an object.

The bottom end of the rotary shaft 30 of the invention is equipped with a dustproof board 50. The bottom face of the dustproof board 50 is a plane face 52. The dustproof board 50 can be integrally formed with the rotary shaft 30. Alternatively, the dustproof board 50 can be an independent part (as shown in FIG. 2) fixedly connected with the rotary shaft.

Figure 2:
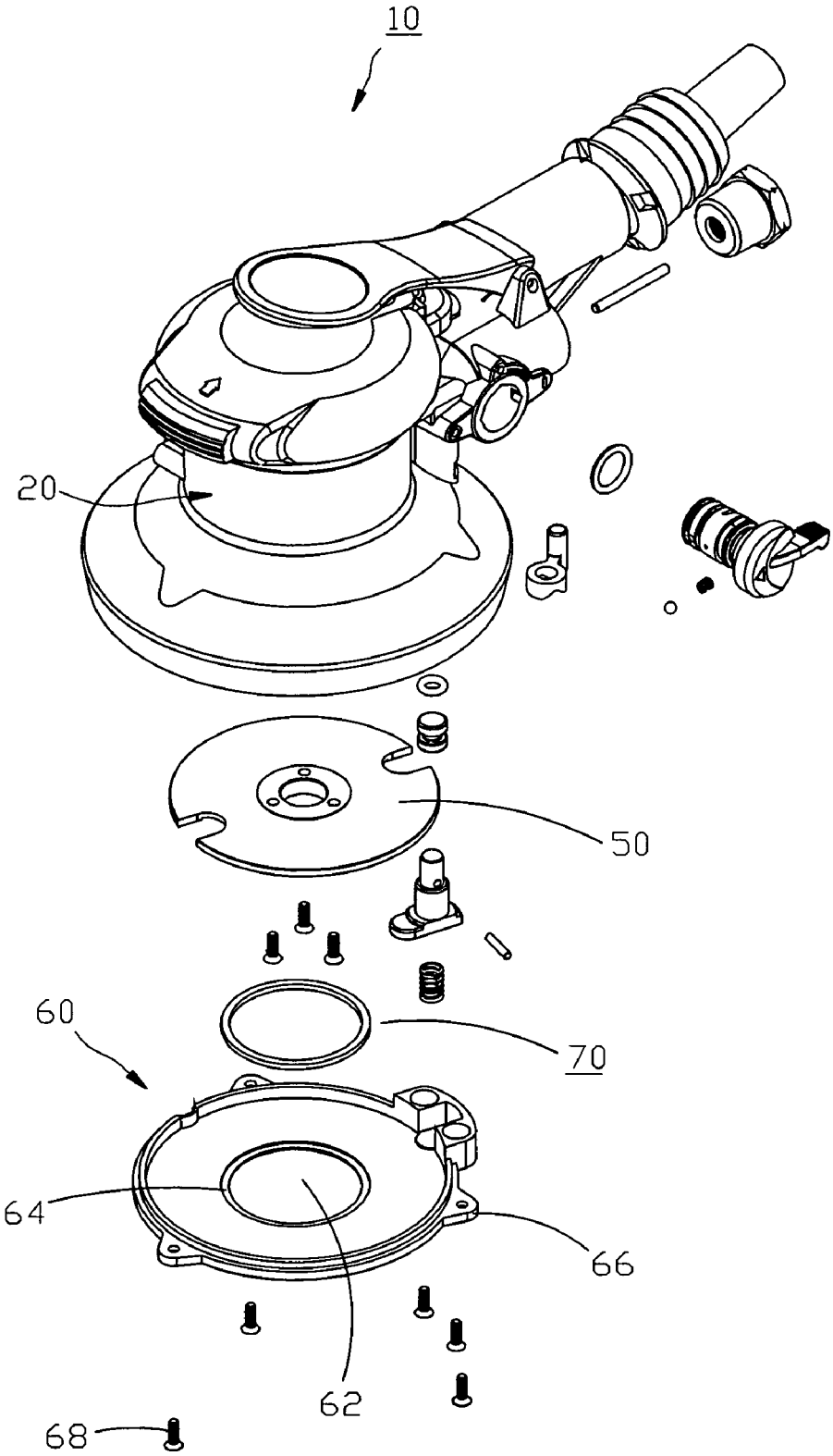
FIG. 2 is a perspective exploded view of the embodiment of FIG. 1.

The present invention further includes a bottom cover 60 as shown in FIG. 2. The bottom cover 60 is formed with a central through hole 62. An annular groove 64 is formed on top face of the bottom cover 60 and preferably adjacent to the through hole 62. Screws 68 are screwed through three lugs 66 formed on the circumference of the bottom cover to fix the bottom cover 60 at the opening of the bottom end of the main body 20 for sealing the bottom end. The plane face 52 of the dustproof board 50 is larger than the through hole 62 to cover the top face of the bottom cover 60 as shown in FIG. 1. The pivot hole 34 of the rotary shaft 30 is aligned with the through hole 62, whereby the central shaft 36 of the grinding disc 35 can be fitted into the rotary shaft.

An annular sealing member 70 such as a fabric-made member or an airtight member is mounted in the annular groove 64 and located between the plane face 52 and the top face of the bottom cover 60, keeping the both 52, 60 sealed. Therefore, dusts, chips and dirt are prevented from passing through the through hole 62. In the case of fabric-made member such as woolen felt or fabric-made dustproof cotton, larger particles of dusts and chips can be isolated. In the case of airtight member such as rubber-made or plastic-made leakproof ring, all large and small particles can be isolated.

According to the above structure, the bottom cover 60 is sealed connected with the bottom end of the main body 20. Also, the bottom cover 60 is sealed connected with the plane face 52 of the dustproof board 50 so that the dirt, dusts and chips can be effectively isolated. During rotation of the rotary shaft 30 and the dustproof board 50, the sealing member 70 still seals the gap between the plane face 52 and the bottom cover 60. Therefore, the chips produced in the grinding procedure cannot enter the space 22 of the main body so that the interior of the main body can keep clean. The components of the grinder can be thus prevented from being contaminated so that the grinder can normally function and have longer using life.

It should be noted that the outer diameter of the rotary shaft 30 can be larger than the through hole 62 of the bottom cover and the plane face is directly formed on the bottom end of the rotary shaft.

Figure 3:
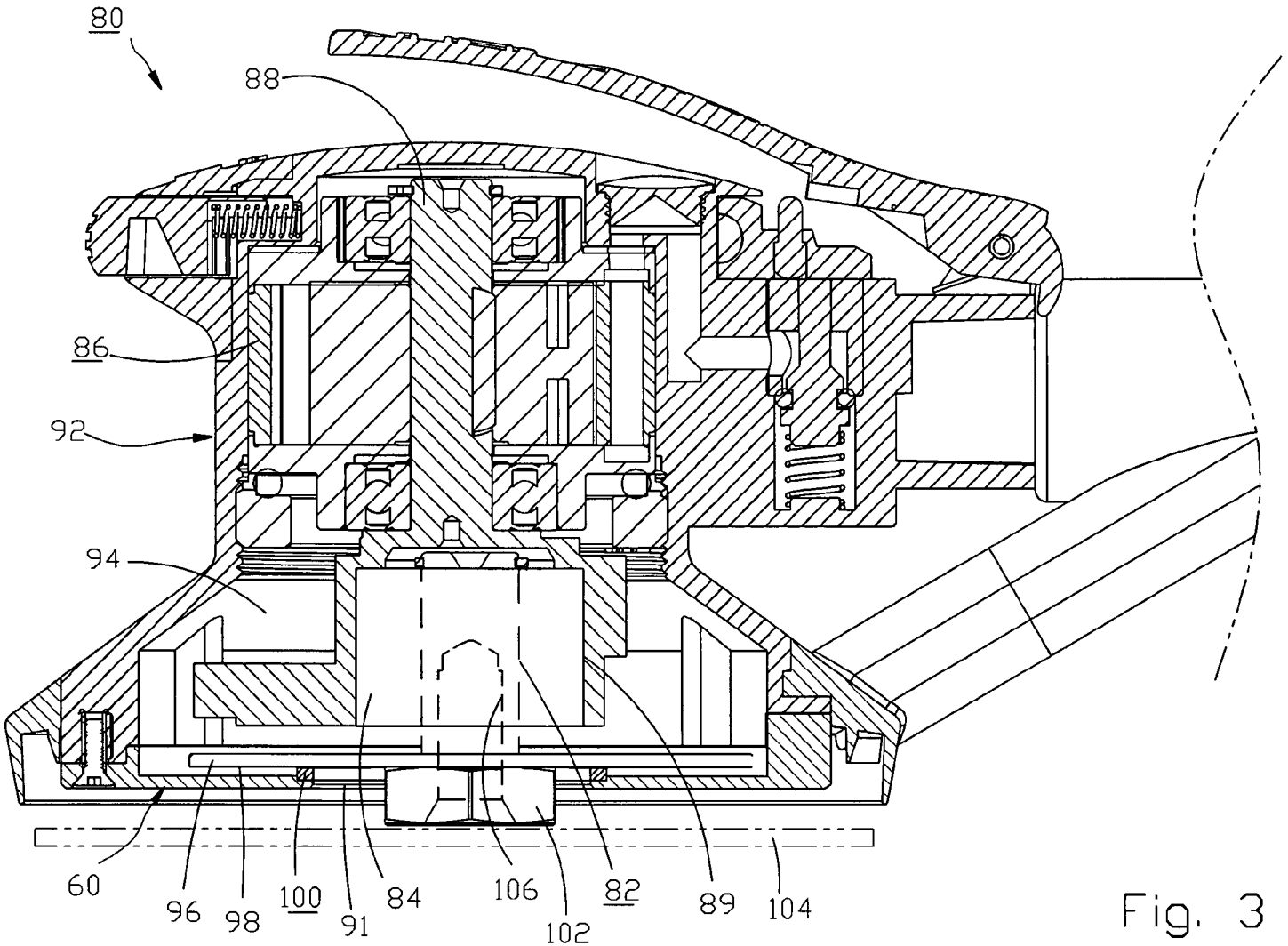
FIG. 3 is a sectional assembled view of another embodiment of the present invention.
Figure 4:
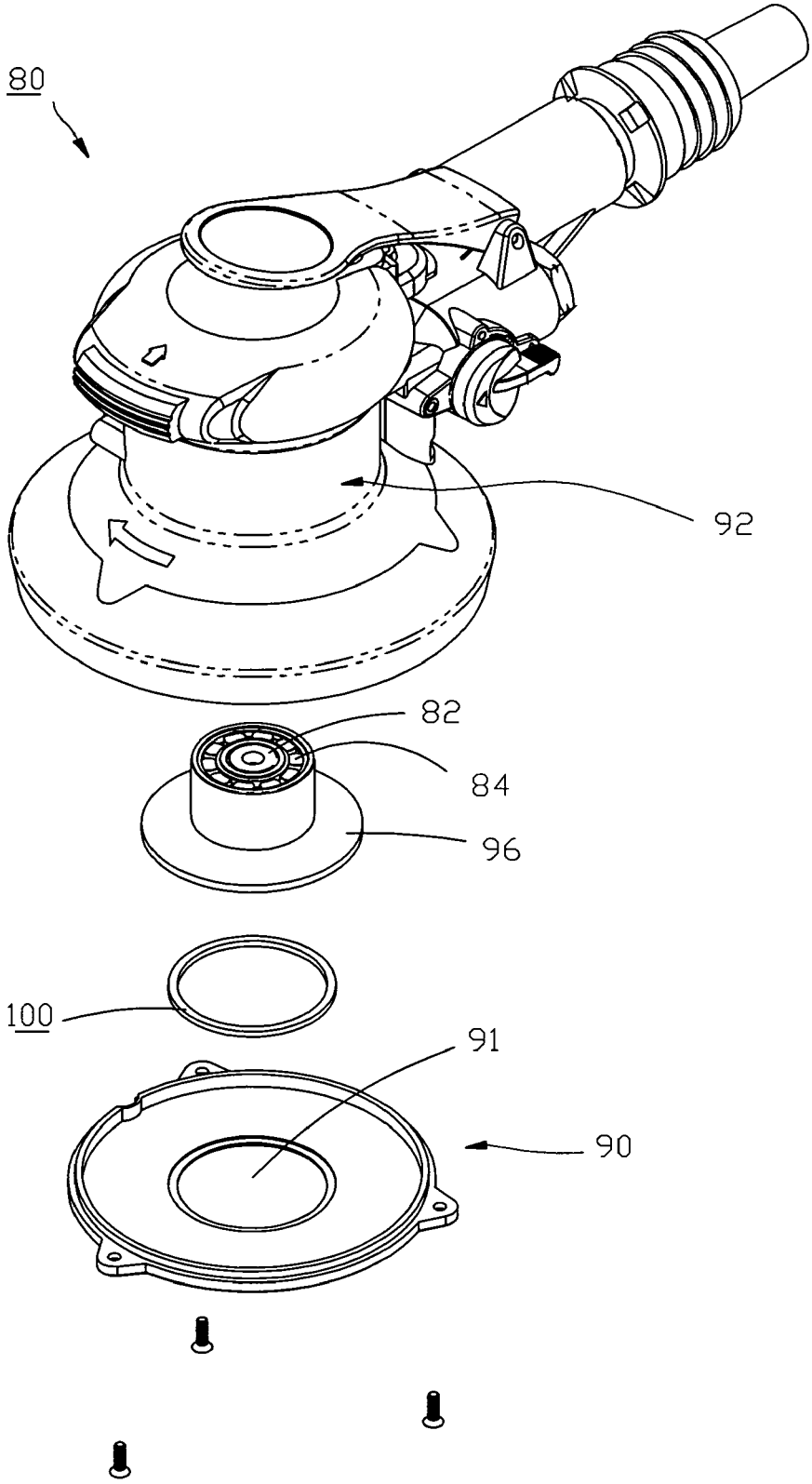
FIG. 4 is a perspective exploded view of the embodiment of FIG. 3.

FIGS. 3 and 4 show another embodiment of the grinder 80 of the present invention. In FIG. 3, the rotary shaft is not sectioned. The structure of this embodiment is substantially identical to that of the first embodiment. The rotary shaft 82 is fitted in a bearing 84 and then fitted in a recess 89 of the bottom end of the driving shaft 88 of the driving unit 86, and is drivable by the driving shaft. A bottom cover 90 is disposed at the bottom end of the main body 92 for sealing the space 94 of the main body. The bottom end of the rotary shaft 82 is equipped with a dustproof board 96. The bottom face of the dustproof board is a plane face 98 larger than the through hole 91 of the bottom cover to cover the top face of the bottom cover. A sealing member 100 is disposed between the plane face and the top face of the bottom cover so as to keep them sealed. In addition, the bottom end of the rotary shaft has a hexagonal head section 102 under the plane face 98. The head section protrudes from the through hole 91 of the bottom cover. The central shaft of the grinding disc 104 is mounted in the pivot hole 106 of the rotary shaft.

This embodiment also can isolate dirt, dusts and chips from the interior of the main body of the grinder.

Figure 5:
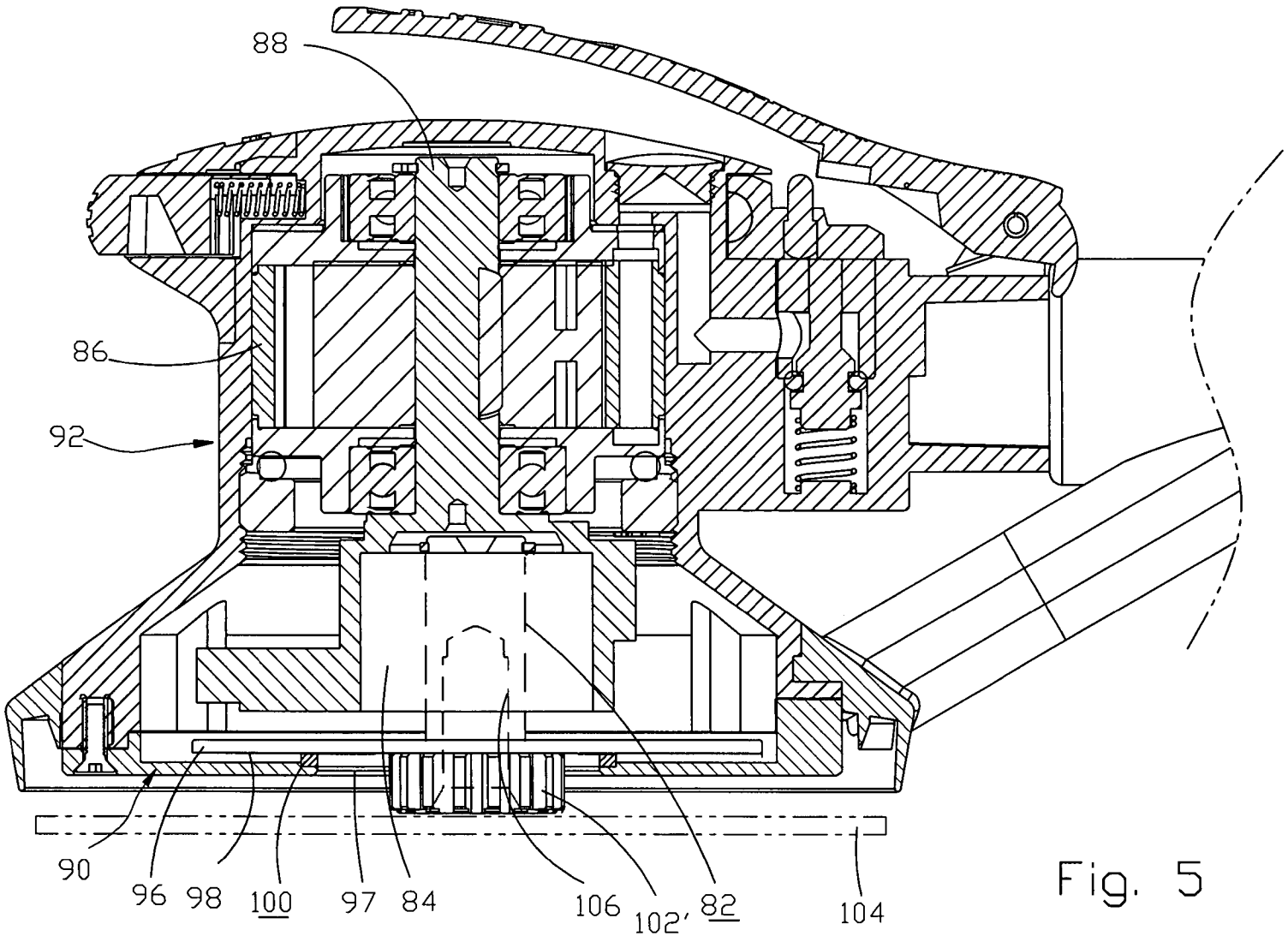
FIG. 5 is a longitudinal sectional view of still another embodiment of the present invention.

FIG. 5 shows still another embodiment of the grinder of the present invention. The structure of this embodiment is substantially identical to that of the embodiment of FIG. 3 and the identical components are denoted with the same reference numbers. In this embodiment, the head section 102' of the rotary shaft 82 has a toothed outer circumference.

Figure 6:
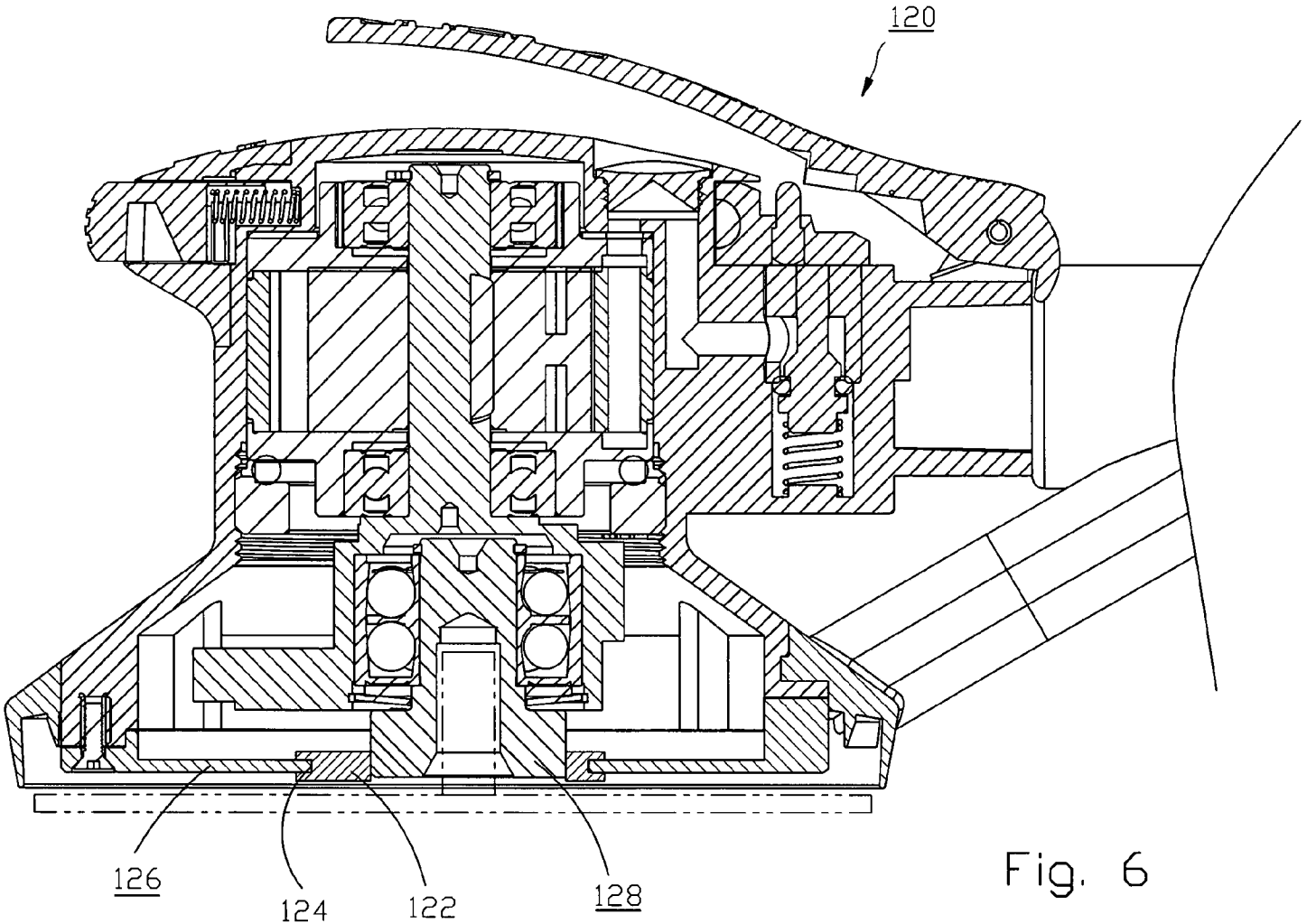
FIG. 6 is a longitudinal sectional view of still another embodiment of the present invention.

FIG. 6 shows still another embodiment of the grinder 120, wherein the sealing member 122 is disposed at the through hole 124 of the base cover 126, and the gap between the through hole 124 and the circumference of the rotary shaft 128 is sealed by the sealing member 122 to prevent dust from entering the grinder.

The above embodiments are only used to illustrate the present invention, not intended to limit the scope thereof. Many modifications of the above embodiments can be made without departing from the spirit of the present invention.

What is claimed is:

1. A dustproof grinder comprising:

a main body, a bottom end of the main body being inward recessed to form a space;

a driving unit mounted in the main body;

a rotary shaft vertically connected with and drivable by the driving unit, a bottom end of the rotary shaft having a plane face facing downward;

a bottom cover formed with a through hole, the bottom cover being disposed at the bottom end of the main body for sealing the space thereof, the rotary shaft being aligned with the through hole, the plane face being larger than the through hole and positioned above a top face of the bottom cover; and a sealing member disposed between the plane face and the top face of the bottom cover, the plane face and the bottom cover being sealed by the sealing member.

2. The dustproof grinder as claimed in claim 1, wherein a dustproof board is disposed on a circumference of the rotary shaft, the dustproof board having an outer diameter larger than that of the rotary shaft, the dustproof board having a bottom face serving as the plane face.

3. The dustproof grinder as claimed in claim 1, wherein the sealing member is an annular member.

4. The dustproof grinder as claimed in claim 3, wherein the top face of the bottom cover is formed with an annular groove in which the sealing member is disposed.

5. The dustproof grinder as claimed in claim 4, wherein the annular groove is adjacent to the through hole.

6. The dustproof grinder as claimed in claim 2, wherein the sealing member is an annular member.

7. The dustproof grinder as claimed in claim 6, wherein the top face of the bottom cover is formed with an annular groove in which the sealing member is disposed.

8. The dustproof grinder as claimed in claim 7, wherein the annular groove is adjacent to the through hole.

9. The dustproof grinder as claimed in claim 1, wherein the sealing member is made of fabric.

10. The dustproof grinder as claimed in claim 1, wherein the sealing member is made of polymer.

11. The dustproof grinder as claimed in claim 1, wherein the bottom end of the rotary shaft has a head section under the plane face, the head section protruding from the through hole of the bottom cover.

12. The dustproof grinder as claimed in claim 11, wherein the head section is polygonal.

13. The dustproof grinder as claimed in claim 11, wherein the head section of the rotary shaft has a toothed outer circumference.

14. The dustproof grinder as claimed in claim 1, wherein the diameter of the bottom end of the rotary shaft having a bottom face serving as the plane face.

* * * * *